United States Patent [19]

Delassus

[11] 4,429,731

[45] Feb. 7, 1984

[54] TRANSLATING FIELD INDUCTOR FOR PRODUCING A DIRECTIONALLY ORIENTED FLUX WITHIN THE STIRRING ROLLER OF A CONTINUOUS CASTER FOR SLABS

[75] Inventor: Jean Delassus, Montmorency, France

[73] Assignee: CEM Compagnie Electro-Mecanique, Paris, France

[21] Appl. No.: 324,099

[22] Filed: Nov. 23, 1981

[30] Foreign Application Priority Data

Nov. 25, 1980 [FR] France ..... 80 24960

[51] Int. Cl.[3] ..... B22D 27/02

[52] U.S. Cl. ..... 164/504; 164/468

[58] Field of Search ..... 164/468, 504, 499, 147.1

[56] References Cited

U.S. PATENT DOCUMENTS 3,882,923 5/1975 Alberny et al. ..... 164/504

4,294,304 10/1981 Delassus ..... 164/504

*Primary Examiner*—Kuang Y. Lin

*Attorney, Agent, or Firm*—Burns, Doane, Swecker & Mathis

[57] ABSTRACT

A translating field inductor for the stirring roller of a continuous slab caster includes a grooved arbor carrying flat magnetic sheets disposed parallel to the axis of the arbor, the latter and the sheets being notched by a series of circumferential grooves spaced over the length of the arbor and housing circular induction coils. In order to concentrate the magnetic flux on the moving slab in the course of the continuous casting, the arbor is stationary and is made of a nonmagnetic metal with good electrical conductivity. It has a longitudinal groove with a wide transverse cross section housing a single packet of sheets, which constitutes the magnetic core of the inductor. The arbor forms a screen for the magnetic flux generated by the induction coils with the entire assembly being such that the magnetic flux is oriented in a fixed, prescribed direction.

3 Claims, 4 Drawing Figures

TRANSLATING FIELD INDUCTOR FOR PRODUCING A DIRECTIONALLY ORIENTED FLUX WITHIN THE STIRRING ROLLER OF A CONTINUOUS CASTER FOR SLABS

BACKGROUND OF THE INVENTION

The present invention relates to a device for stirring molten metal in a continuous casting installation during the cooling of the cast product, and more particularly to the casting of wide, flat products, generally designated as slabs.

Devices for stirring liquid metal by means of linearly translating or rotating magnetic fields are known. These fields are produced by inductors located in the guide and support rollers for the continuously cast product. Such devices are described, for example, in French Patent Application No. 72/20,546, published under Patent No. 2,187,467 and in its first and second addition certificates Nos. 73/19,399 and 73/19,400, published respectively under Patent Nos. 2,231,454 and 2,231,455. French Pat. No. 2,187,467, without entering into the details of the construction of the inductor itself, teaches that an inductor may either be made integral with the roller and rotate with it, or may be supported fixedly inside the rotating roller. The first addition certificate No. 2,231,454 describes an embodiment of an inductor with a translating field which is integral in rotation with the hollow body of revolution wherein it is located. The inductor comprises a magnetic core in the form of an arbor of magnetic stainless steel, having a plurality of deep longitudinal grooves extending over the entire length of the arbor and spaced uniformly in the circumferential direction. A plurality of packets of flat magnetic sheets, disposed parallel to the axis of the arbor, are fitted into the grooves. The arbor and the sheets are notched by a series of annular slots that are spaced over the length of the arbor and house circular inductive coils.

The disadvantage of the devices described in the abovecited publications is the lack of power associated with them. It is conceivable that this lack of power is the result of the fact that the magnetic field produced by the inductor is distributed in azimuth in all directions around the axis of the roller. Consequently, the density of the magnetic flux emanating in the useful direction, i.e. toward the zone of contact between the roller and the slab, is weak because the magnetic flux is uselessly dispersed in the other directions, in particular in the direction opposite to the slab and in the direction of the adjacent rollers located upstream and downstream from the roller under consideration, with respect to the direction of movement of the casting.

OBJECT AND SUMMARY OF THE INVENTION

It is therefore an object of the present invention to provide an inductor for producing a linearly translating field within the stirring roller of a continuous slab caster and is capable of concentrating the magnetic flux in the direction of the contact zone between the roller and the slab, as well as reduce magnetic leakage in other directions, in order to better utilize the magnetic capacity of the inductor core.

According to the present invention, this object and its attendant advantages are achieved with an inductor having a grooved arbor carrying flat magnetic sheets disposed parallel to the axis of the arbor, the latter and the sheets being notched by a series of annular slots spaced over the length of the arbor and housing a plurality of circular induction coils. The inductor is characterized in that the arbor is stationary, is made of a nonmagnetic material that is a good conductor of electricity, and comprises a longitudinal groove with a large transverse cross section housing a single packet of magnetic sheets, which in itself constitutes the magnetic core of the inductor. In addition, the arbor constitutes a screen for the magnetic flux generated by the induction coils, with its configuration being such that the magnetic flux is oriented in a fixed prescribed direction.

In operation, the inductor according to the invention is maintained in a fixed orientation with respect to the continuous casting, inside the roller so as to insure the guidance and support of the continuously cast product. The inductor is mounted in a fixed orientation so that the plane of the leaves of the packet of magnetic sheets forming the core is perpendicular to the surface of the continously cast slab, and the free edge of the magnetic sheets is located facing the zone of contact between the roller and the slab.

Each induction coil completely surrounds the inductor by passing in front of the magnetic core formed by the packet of sheets and behind the arbor. Because the magnetic core is fitted in the groove of an arbor made of a metal that is nonmagnetic and a good conductor of electricity, the three faces of the core which are not facing the zone of contact between the roller and the slab are protected against the loss of flux by the screening effect resulting from the currents induced in the arbor. Consequently, in operation the magnetic flux is essentially directed to the zone of contact between the roller and the slab.

BRIEF DESCRIPTION OF THE DRAWINGS

An embodiment of the present invention shall be described hereinafter, purely as an indicative example and in a nonlimiting manner, with reference to the drawings attached hereto, wherein.

DETAILED DESCRIPTION

Figure 1:
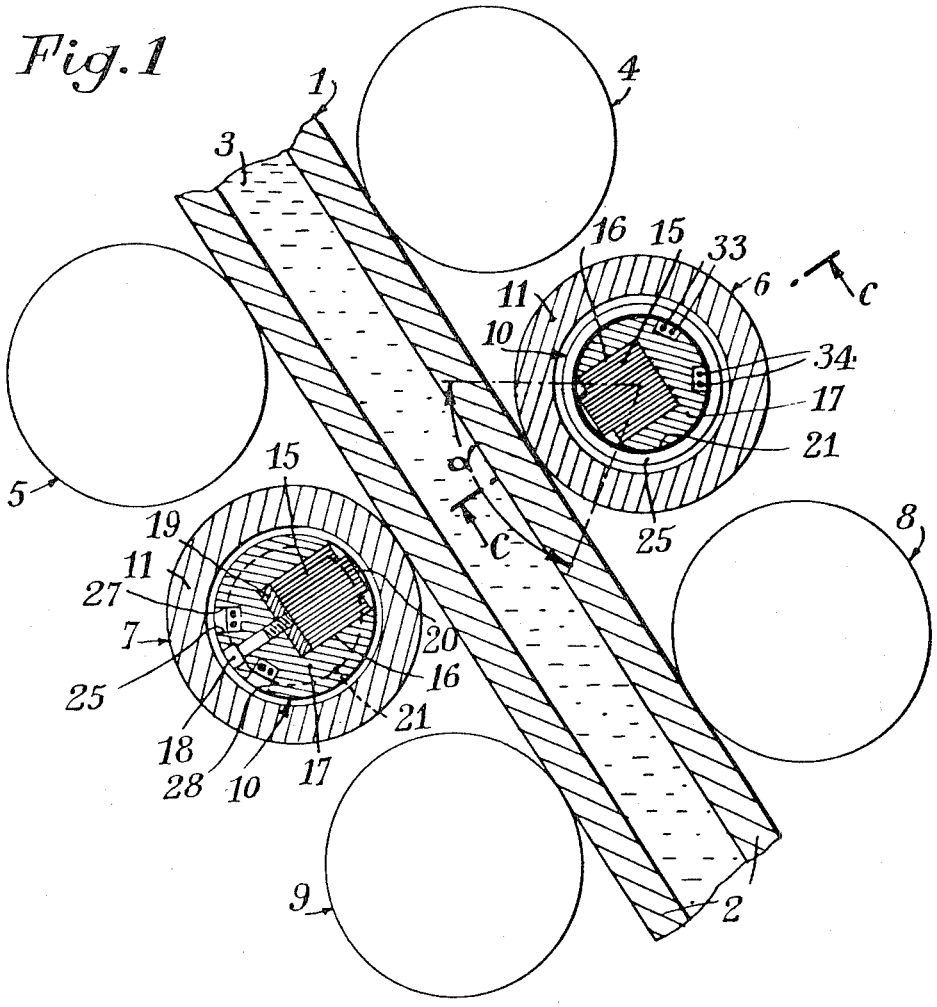
FIG. 1 illustrates two stirring rollers placed on either side of a slab in the course of continuous casting, each equipped with an inductor according to the present invention, one of the rollers being shown in a transverse section along the line A—A in FIG. 2, the other being shown in a transverse section along the line B—B in FIG. 2.
Figure 2:
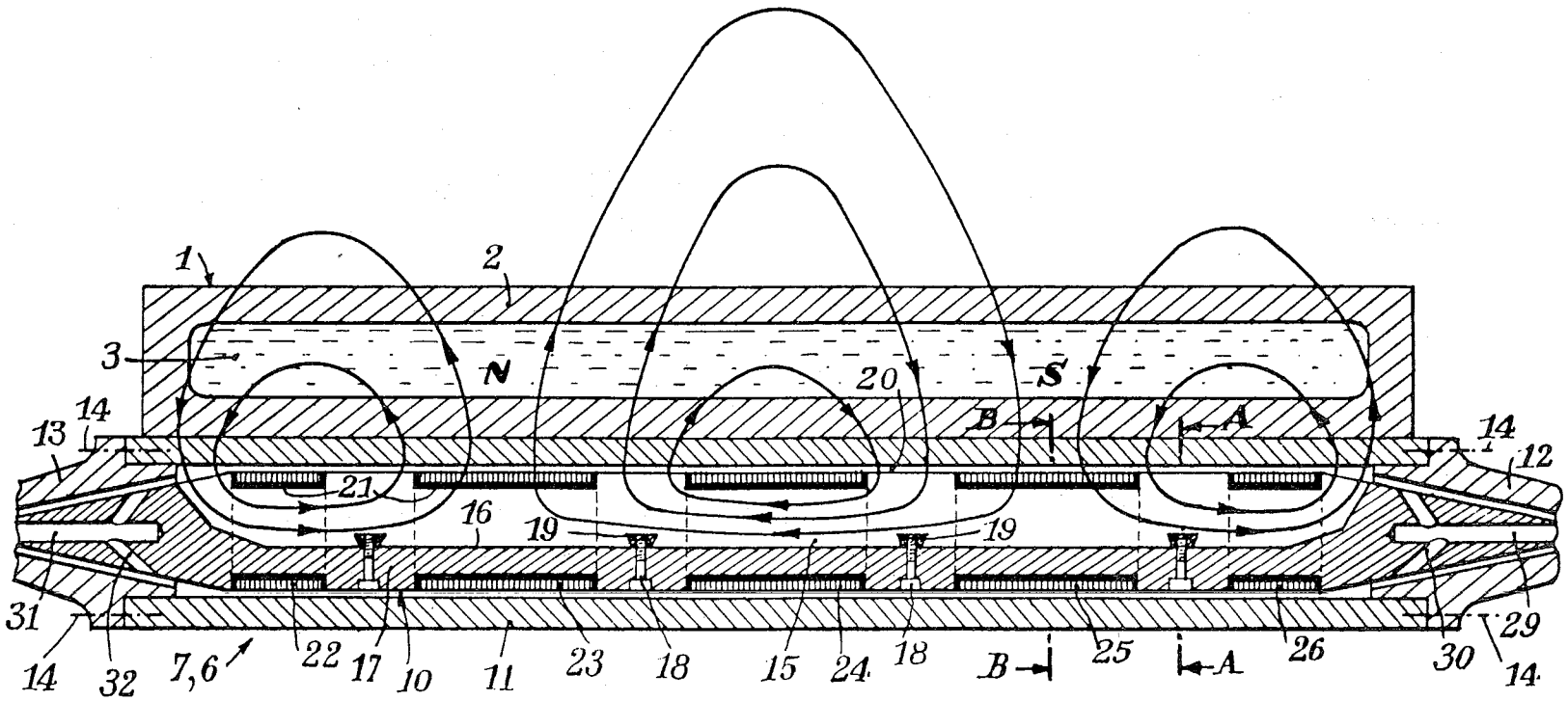
FIGS. 2 and 3 each illustrate the two stirring rollers of FIG. 1, in an axial cross section along the line C—C of FIG. 1, and the spectrum of the lines of the magnetic flux, respectively at two separate instants of excitation, separated by a quarter of the period of alternating current, in the case of a bipolar, two phase inductor.
Figure 3:
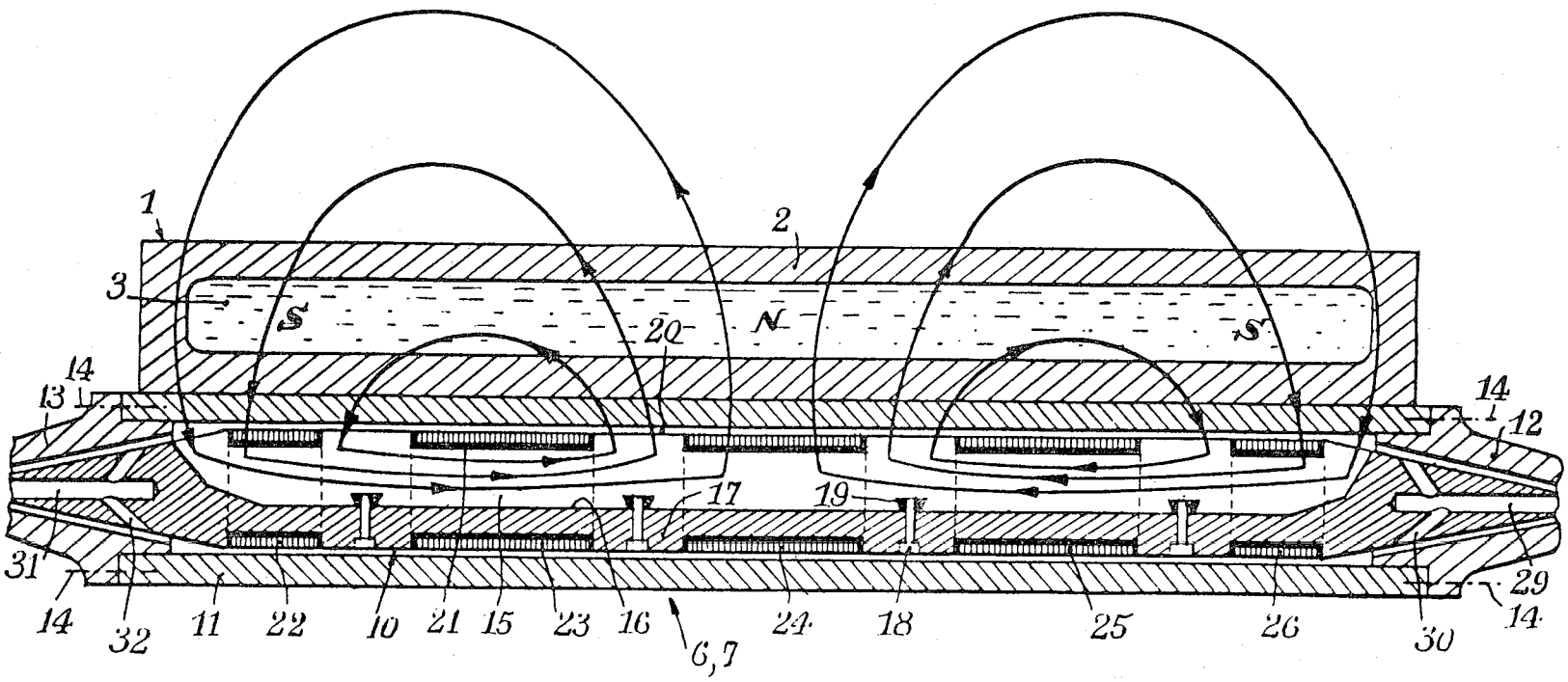

In FIGS. 1 to 3, part of a slab 1 is illustrated in the course of continous casting, with its outer skin 2 of metal being already solidified and its metal core 3 still molten. The slab 1 is guided and supported during the casting by a number of rollers, such as the rollers 4 to 9. As is known, some of the rollers can be freely rotating, while others may be driven in rotation. As is also known, certain rollers, for example the rollers 6 and 7, are hollow and house an inductor 10 for magnetically stirring the core 3 of the molten metal. The latter rollers are usually called "stirring rollers".

Each stirring roller 6 or 7 comprise a hollow cylindrical shell 11 of a nonmagnetic material such as stainless steel. The ends of two hollow arbors, 12 and 13, are fastened to the ends of the shell 11 by means of screws, such as 14. Bearings (not shown) are provided for the rotation of the assembly 11, 12, 13 around its axis.

The inductor 10 is located inside the cylindrical shell 11. The inductor comprises a magnetic core 15 consisting of a single packet of thin magnetic sheets, suitably insulated from each other in a known manner by means of insulators (not shown). The laminated magnetic core 15 is fitted into a longitudinal groove 16 machined into a solid arbor 17 of a nonmagnetic metal that is also a good conductor of electricity, for example an aluminum alloy or a copper alloy. The groove 16 has a wide transverse cross-section, and is deep, relative to the diameter of the arbor, and effectively forms a magnetic screen surrounding three sides of the core. The magnetic core 15 is maintained in place in the longitudinal groove 16 by means of several bolts 18 cooperating with keys 19 located in transverse grooves with dovetail cross sections machined into the face of the magnetic core 15 facing the bottom of the longitudinal groove 16. The free face 20 of the magnetic core 15 is flush with the cylindrical surface of the arbor 17 and is oriented toward the adjacent face of the slab 1.

The arbor 17 and the magnetic core 15 are notched by a series of wide, circumferential grooves 21 spaced over the length of the arbor 17 and housing cylindrical induction coils 22–26. The coils 22–26 consist, for example, of windings of a flat, insulated copper conductor and are suitably insulated from the magnetic core 15 by means of insulation placed in the bottom of the circumferential grooves 21 and on the sides of the latter.

The ends of the arbor 17 pass, with a certain radial clearance, respectively through the ends of the hollow arbor 12 and 13, and are supported by and rigidly secured to a support (not shown) so that the arbor 17 remains stationary when the assembly 11, 12, 13 is rotating around its axis.

Two narrow, longitudinal grooves 27 and 28 (FIG. 1), extending over the entire length of the arbor 17 and slightly deeper than the circumferential grooves 21, and passages 29, 30, 31 and 32 (FIG. 2) formed in the two ends of the arbor 17 are provided to house conductors 33 and 34 (FIG. 4) for feeding power to the coils 22 to 26.

Figure 4:
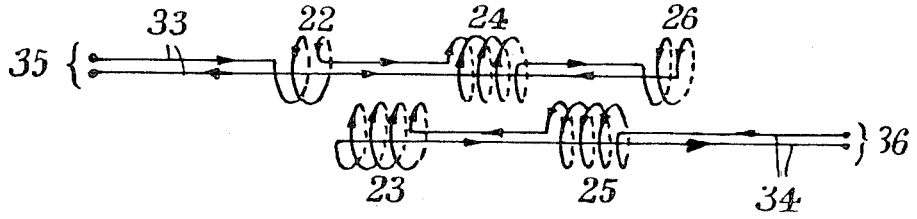
FIG. 4 represents a winding diagram of the inductor shown in FIGS. 2 and 3.

As shown in FIG. 4, the coils 22 to 26 are divided into two groups of coils, consisting respectively of the coils 22, 24 and 26 and the coils 23 and 25. The coils 22, 24 and 26 are wound in alternating directions, connected electrically in series and connected by means of the conductors 33 to two external terminals 35. The terminals are connected with one of the two phases of a source of two phase alternating current (not shown). Similarly, the coils 23 and 25 are wound in opposite directions, connected electrically in series and connected by means of the conductors 34 to two other external terminals 36. These terminals are connected with the second phase of the source of two phase alternating current. The end coils 22 and 26 preferably contain approximately half the number of windings of the central coil 24, and the coils 23 and 25 each have approximately the same number of windings as the coil 24.

In operation, the magnetic flux generated by the inductor 10, when the current is at a maximum in the first phase and zero in the second phase, produces the field shown in FIG. 2, with a north pole between the coils 22 and 24 and a south pole between the coils 24 and 26. It can be seen from FIG. 2 that the closure of the flux path takes place in the longitudinal magnetic core 15, wherein the lines of the flux are very tight, which can lead to the magnetic saturation of the laminated core. It can also be seen that the arbor 17, which is made of a nonmagnetic metal with good electrical conductivity, constitutes a highly effective screen which prevents the escape of the magnetic flux toward the rear face of the inductor 10 as well as the generation of induced currents in the arbor 17 that oppose the passage of the magnetic flux. As a result, the saturation of the magnetic core 15 is utilized almost entirely for the generation of a useful magnetic current.

The same observation may be made at the instant when the current attains its maximum in the second phase and is zero in the first phase, i.e. when the coils 23 and 25 are excited to form a north pole between them and two south poles at the ends, as illustrated in FIG. 3. In this case, the saturation of the magnetic core 15 is a maximum at the location of the coils 23 and 25, and the leakage of the magnetic flux to the rear is again prevented by the screen formed by the arbor 17.

Furthermore, as can be particularly seen in FIG. 1, the arbor 17 and the induction currents generated therein are also opposed to the leakage of magnetic flux at the sides of the magnetic core 15. Consequently, the magnetic flux is mainly concentrated in a dihedron with the angle $\alpha$ representing the useful angle of stirring.

When the two phases are supplied succesively and periodically, at a low frequency, a magnetic field that translates in the axial direction of the stirring roller is obtained, the flux lines of which sweep the core 3 of the slab 1, thereby stirring the molten metal.

It is apparent from the foregoing description that the inductor according to the present invention provides a maximum utilization of the magnetic capacity of the laminated core 15 in producing a useful magnetic stirring flux. It produces useful stirring power 5 to 6 times superior to that obtained with the known inductors of the prior art.

Even though the embodiment described hereinabove is related particularly to the case of a bipolar, two phase inductor, it will be appreciated that the same concept may be applied to a polyphase inductor having any number of poles. However, the two phase, bipolar solution offers the advantages of simplicity and efficacy that can be exploited profitably by virtue of the present invention.

It will be appreciated that the embodiment described hereinabove is presented merely as a purely illustrative and nonlimiting example and that numerous modifications may be effected by those skilled in the art without exceeding the scope of the present invention.

What is claimed is:

1. An inductor for generating a linearly translating magnetic field from within a stirring roller of a continuous slab casting apparatus, comprising:

a stationary arbor disposed within the stirring roller, said arbor being made of a nonmagnetic metal having good electrical conductivity, and including a single longitudinal groove having a wide transverse cross-section relative to the diameter of said arbor;

a magnetic core comprising a plurality of flat magnetic sheets disposed parallel to the axis of said arbor within said wide groove such that the arbor effectively forms a screen surrounding three sides of said core;

a series of circumferential grooves forming notches in said arbor and said core and being spaced over the length of said arbor; and a plurality of circular induction coils respectively housed in said circumferential grooves.

2. The inductor of claim 1 wherein said arbor further includes narrow longitudinal grooves extending over the length of the arbor and passages in the ends of said arbor for housing supply conductors for feeding an alternating current to said coils.

3. The inductor of claim 1 or 2, wherein said coils are divided into two sets and are connected to a source of two phase alternating current to thereby form a biopolar inductor.

* * * * *